United States Patent [19]

Eger

[11] Patent Number: 4,629,098

[45] Date of Patent: Dec. 16, 1986

[54] PORTABLE LIQUID DISPENSER

[76] Inventor: Douglas R. Eger, 96 Lakeview Village, Montgomery, Tex. 77356

[21] Appl. No.: 661,084

[22] Filed: Oct. 15, 1984

[51] Int. Cl.[4] ..... B65D 83/14

[52] U.S. Cl. ..... 222/175; 222/400.8; 222/529; 222/530; 138/115; 220/903; 224/148

[58] Field of Search ..... 222/175, 400.8, 529, 222/530, 400.7, 401; 220/903; 138/115; 224/148

[56] References Cited

U.S. PATENT DOCUMENTS

| | | | |
|---|---|---|---|
| 1,919,257 | 7/1933 | Renzenhausen | 222/400.8 X |
| 3,147,889 | 9/1964 | Dolgin | 222/175 X |
| 3,160,330 | 12/1964 | Pollitt | 222/530 X |
| 3,814,288 | 6/1974 | Westrich | 222/183 X |
| 4,022,347 | 5/1977 | Noble | 222/400.8 X |
| 4,030,634 | 6/1977 | Osborn | 222/400.8 X |
| 4,153,181 | 5/1979 | Parker et al. | 222/400.8 X |
| 4,420,097 | 12/1983 | Motsenbocker | 222/175 X |

FOREIGN PATENT DOCUMENTS

| | | | |
|---|---|---|---|
| 275131 | 3/1952 | Switzerland | 222/400.8 |

*Primary Examiner*—Joseph J. Rolla
*Assistant Examiner*—Frederick R. Handren
*Attorney, Agent, or Firm*—Neal J. Mosely

[57] ABSTRACT

A portable liquid dispenser suitable for use by persons while performing an activity comprises a thermally-insulated container for liquids having a fastener for releasably attaching the same for access by the user. A single flexible dispensing tube having a pair of parallel longitudinal passages is connected at one end connected to the filling cap of the container and at the other end to a dispensing valve for discharging liquids from the container. The container is pressurized by a compressible bulb sealed end around the distal end of the dispensing tube in communication with the interior of the container through one longitudinal passage in the tube. A check valve is disposed in the air inlet of the fitting and another check valve is disposed in the air inlet of the dispensing valve which cooperate with the bulb to force air into the container. A number of compressions of the bulb forces air into the container to pressurize the liquid therein which flows through the other longitudinal passage on demand of the user by pressing a plunger on the dispensing valve.

27 Claims, 6 Drawing Figures

PORTABLE LIQUID DISPENSER

BACKGROUND OF THE INVENTION

1. Field of the Invention

This invention relates generally to portable liquid dispensers and more particularly to a thermally-insulated dispenser having manually operated means for effecting and controlling the flow of liquid therefrom.

2. Brief Description of the Prior Art

Portable liquid dispensers are known in the art. Many prior art portable liquid dispensers are large metal containers which are prepressurized and strapped onto the back of a person for vending liquid refreshments at ball games and other events. The present invention is designed for recreational use by backpackers, bicyclists, hunters, campers, or by telephone linemen, electricians, carpenters, or other persons who may desire cool or warm fluids when it may not be otherwise convenient to stop the activity which they are engaged in.

Bottles and bottle mounts for bicycles are commercially available. Most of which consist of a wire cage or basket which is affixed to the frame of the bicycle and receive a bottle. The use of these devices is often cumbersome or distracting and dangerous to the cyclist. There are several patents which disclose various liquid Wooten, U.S. Pat. No. 3,348,741 disclose a dispenser apparatus adapted to be carried by a user. The apparatus comprises a storage tank having an arcuate front side for fitting snugly against the users back, and a pair of straps for supporting the tank. A resilient dispenser tube is secured at one end to the bottom of the tank and its other end is provided with a dispenser valve having a handle which when depressed enables the liquid to escape from the tank. The valve is mounted on a tray which extends partially around the body of the user. The tank is continuously pressurized by a container of pressurized gas connected to the tank.

Kassel, U.S. Pat. No. 2,558,181 discloses a portable dispensing device comprising an outer casing provided with straps and a belt and a complemental inner tank. A flexible tube communicates with the inner tank and has a dispensing faucet on its free end. Both the inner tank and the outer casing are individually insulated, and provision is made for using carbon dioxide gas that is released by dry ice in the inner tank to carbonate the beverage therein and provide a dispensing pressure head.

Osborne, U.S. Pat. No. 2,013,358 discloses a knapsack water bag comprising a knapsack having attaching straps for securing the same upon the back of a user and a foldable and collapsible rubber water bag conforming to the internal contour of the knapsack. A discharge fitting is connected to the bottom of the bag and projects through an opening in the knapsack. Liquids are dispensed by gravity flow.

Charpiat, U.S. Pat. No. 2,684,787 discloses an improvement for a transportable dispensing container for carbonated beverages of the type including a container enclosing an externally iced beverage containing tank. The improvement comprises a spacing plate on the back wall of the container to provide an air space between the container and the vendor's back, and a valve controlled dispensing tube in communication with the tank through a side wall of the container.

Motsenbocker, U.S. Pat. No. 4,420,097 discloses a portable liquid dispenser with a carrying case. The container is a thin generally pillow shaped member formed of plastic sheet material and the carrying case is a similarly shaped insulated fabric member. A dispensing tube is connected to the interior of the container and has a valve and nozzle at its other end. Gravity flow and the progressive collapse of the container allows liquids to be dispensed at an acceptable rate.

Le Claire, U.S. Pat. No. 984,768 discloses a branding apparatus wherein air is forced through a gasoline container carried in a pouch by means of a rubber squeeze bulb and the gasoline is carried to a branding iron.

Boughton, U.S. Pat. No. 4,345,704 discloses a bottle mount and bottle combination for bicycles. The concave surface of the mount and the complementary surface of the bottle have hoop and loop fastener elements affixed to them. A beverage in the bottle is discharged through a valved dispenser that is designed to be opened using the teeth.

The prior art in general, and none of these patents in particular, disclose the present invention of a portable liquid dispenser having a manual pressurizing means and which is carried in a thermally insulating sleeve adapted to be releasably attached to various articles.

SUMMARY OF THE INVENTION

It is therefore one object of this invention to provide a portable liquid dispenser having means for releasably attaching it to the user or on various articles convenient to the user for allowing its use during the performance of an activity.

Another object of this invention is to provide a portable liquid dispenser whereby the liquids contained therein are thermally insulated.

Another object of this invention is to provide a portable liquid dispenser which allows the liquids contained therein may be manually pressurized quickly and easily by the user.

Another object of this invention is to provide a portable liquid dispenser which allows the liquids contained therein to be easily and quickly discharged at a satisfactory rate superior to gravity or suction induced flow rates.

Another object of this invention is to provide a portable liquid dispenser which is constructed of light weight durable materials, inexpensive to manufacture, and attractive in appearance.

Other objects of the invention will become apparent from time to time throughout the specification and claims as hereinafter related.

The above noted objects and other objects of the invention are accomplished by a portable liquid dispenser suitable for use by persons while performing an activity which comprises a thermally-insulated container for liquids having means for releasably attaching the same for access by the user. A single flexible dispensing tube having a pair of parallel longitudinal passages is connected at one end connected to the filling cap of the container and at the other end to a dispensing valve for discharging liquids from the container. The container is pressurized by a compressible bulb sealed end around the distal end of the dispensing tube in communication with the interior of the container through one longitudinal passage in the tube. A check valve is disposed in the air inlet of the fitting and another check valve is disposed in the air inlet of the dispensing valve which cooperate with the bulb to force air into the container. A number of compressions of the bulb forces air into the container to pressurize the liquid therein which flows through the other longitudinal passage on demand of the user by pressing a plunger on the dispensing valve.

BRIEF DESCRIPTION OF THE DRAWINGS

FIG. 2 is a view in longitudinal cross section of the portable liquid dispenser shown in FIG. 1.

DESCRIPTION OF THE PREFERRED EMBODIMENT

Figure 1:
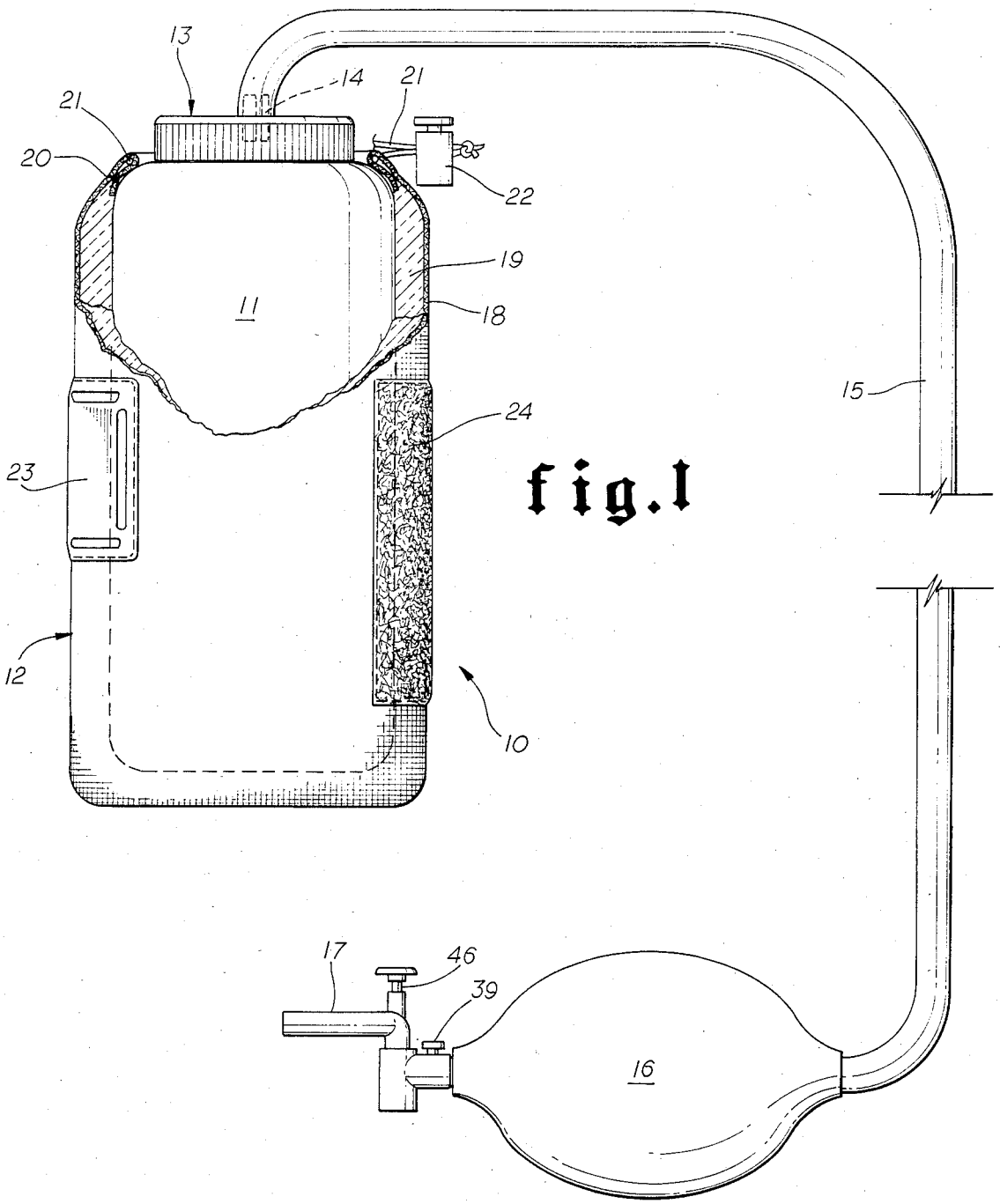
FIG. 1 is a side view, in partial cross section, of a portable liquid dispenser illustrating a preferred embodiment of the invention.

Referring now to the drawings by numerals of reference, there is shown a portable liquid dispenser 10 illustrating a preferred embodiment of this invention. The dispenser 10 comprises a liquid container 11 and an outer, closed-end, insulated sleeve 12. The container 11 is a bottle shaped member formed of suitable material such as polyethylene or polypropylene, preferably of a size to hold a liquid volume of approximately 32 fluid ounces.

A cap 13 is threadedly secured on the threaded open top of the container 11. A fitting 14 on the cap 13 communicates on one side with the interior of the container 10 and on the other side is connected to one end of a dispensing tube 15. Dispensing tube 15 has one end attached to the fitting 14 and its other end passes through a compressible squeeze bulb 16 and has a dispensing valve 17 secured on the end thereof.

The insulated sleeve 12 is a closed-end, cylindrical, cup-shaped or bag-shaped member having an outer layer of durable fabric material 18 sewn together with an inner lining of thermally insulating material 19 which snugly fits the external contour of the container 11. A preferred fabric material is 70–200 weight Nylon cloth (Dow Chemical Co.), and a suitable thermal inner lining material has proven to be ½" or ⅜" polyurethane foam having a density of 1–2 lbs./cu. ft. A hem 20 at the open top of the sleeve 11 contains a draw string 21. The draw string 21 is provided with a suitable cord locking device 22 which allows the sleeve to tightly enclose the container 11 leaving only the cap 13 exposed.

At least one slotted fastener 23 is affixed to the outer surface of the sleeve 12 to receive fastening means such as cords, webbing, or straps, which allow the dispenser 10 to be releasably secured to a bicycle frame, backpack, or the belt of a user.

One element of a hook and loop fabric, e.g. VELCRO, fastener 24 is affixed to the outer surface of the sleeve 12 in a circumferentially spaced relation to the slotted fastener 23 to provide an additional means of releasably securing the dispenser 10. It should be understood that the mating element of the hook and loop fastener would be provided on the appropriate article convenient to the user. Some bicycles may be equipped with commercially available water bottle cages having a hook and loop fastener element.

Figure 3:
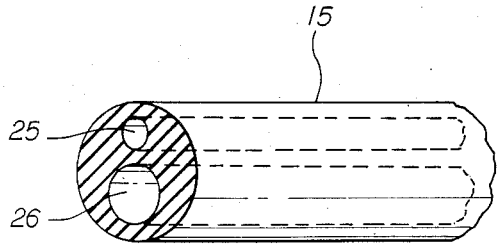
FIG. 3 is an isometric view with the end shown in cross section of a segment of the dispenser tube of FIGS. 1 and 2.
Figure 4:
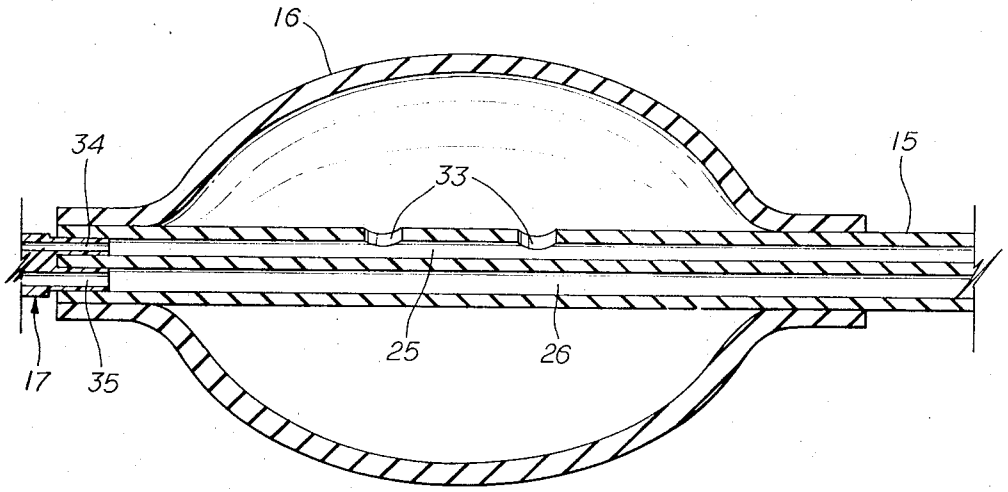
FIG. 4 is a view in longitudinal cross section of the squeeze bulb pump mechanism shown in FIG. 1.

Referring now to FIGS. 2, 3 and 4, the dispensing tube 15 is composed of a length of flexible rubber or plastic tubing having two separate, substantially parallel, passages extending longitudinally therethrough, viz., a small passage 25 for air and a larger passage 26 for liquid. One end of the tube 15 is attached to the fitting 14 on the cap 13 as noted above.

The top of fitting 14 comprises a pair of short upwardly extending tubes 27 and 28 which are sized and spaced to receive the passages 25 and 26, respectively, in fluid-tight relation. The tube 27 has a hollow enclosed chamber which depends from the underside of the cap 13 and contains a small ball to form a check valve mechanism 29. A small opening 30 in the sidewall of the chamber communicates with the interior of the container 11 above the liquid level.

The tube 28 has a short, hollow, open portion 31 which depends from the underside of the cap 13 to receive one end of a length of tubing 32 which extends downwardly therefrom to terminate near the bottom of the container 11. The dispensing tube 15 has a cylindrical exterior surface which extends through and tightly fits a flexible rubber squeeze bulb 16. Openings 33 through the dispensing tube 15 communicate the air passage 25 only to the interior of the bulb 16. The terminal or distal end of the tube 15 receives a dispensing valve 17.

Figure 5:
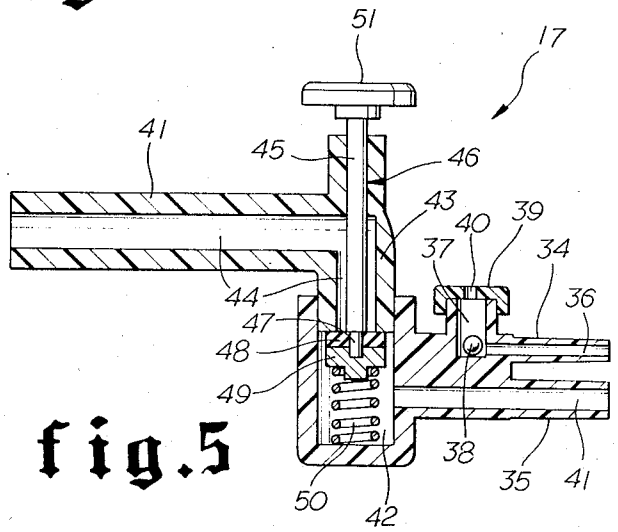
FIG. 5 is a view in longitudinal central section of the dispensing valve mechanism shown in FIG. 1.

Referring now to FIG. 5, the dispensing valve 17 has a pair of short, outwardly-extending tubes 34 and 35 which are sized and spaced to fit tightly into the passages 25 and 26 respectively of the terminal end of the tube 15 to secure the valve 17 thereon at one end of the bulb 15. The tube 34 has an air passage 36 which extends inwardly and terminates in an upwardly extending hollow chamber 37 containing a small ball to form a second check valve mechanism 38. The top of the chamber 37 is closed by a cap 39 having a small aperture 38 therein to communicate the chamber 37 to atmosphere when the ball is spaced from the air passage 34.

The tube 35 has a liquid passage 41 which extends inwardly and terminates in an upwardly extending hollow chamber 42. The top of the chamber 42 receives an inverted L-shaped nozzle 43 having a central passage 44. The tubular shaft portion 45 of a plunger 46 extends through the vertical leg of the nozzle 43 into the chamber 42. Shaft portion 45 has a reduced diameter portion 47 with an O-ring seal 48 retained in place thereon by a disk shaped retainer 49. A compression spring 50 is biased between the bottom of the chamber 42 and the underside of the retainer 49 to urge the seal 48 upwardly against the bottom surface of the vertical leg of the nozzle 43 and seal the central passage 44. The top of the plunger 46 is provided with a disk shaped finger pad 51.

Figure 6:
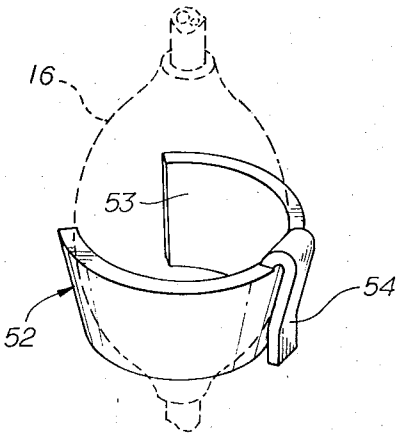
FIG. 6 is an isometric view of a holder for the squeeze bulb member shown in FIGS. 1 and 4.
Figure 7:
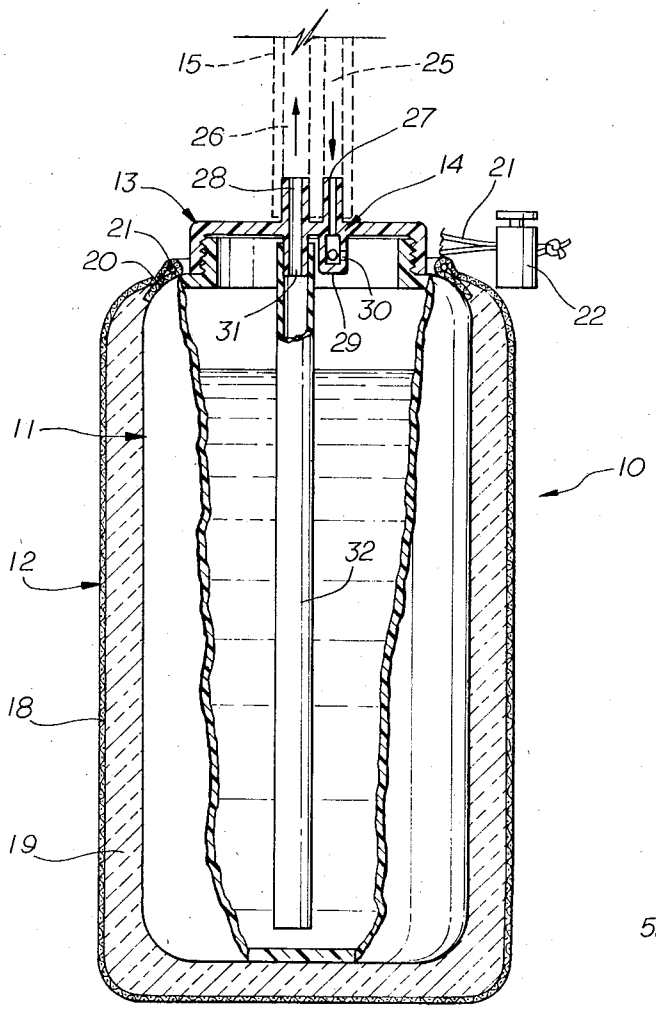

FIG. 6 shows a belt clip holder 52 which may be used to conveniently carry the bulb 16 on the belt of the user. The holder 52 comprises a downwardly tapered sidewall 53 which defines a concave surface of greater than 180° in circumferential extent and a laterally disposed belt clip portion 54. The rubber bulb 16 may be pressed into the sidewall 53 and its resiliency will retain it in place until removed by the user. It should be understood that bulb holders of various shapes having various fastening means may be provided to depending on the particular use of the dispenser.

OPERATION

The dispenser 10 is conveniently attached to the body of the user or the bicycle. The container 11 is pressurized by squeezing the rubber bulb 16. When the bulb 16 is squeezed, air inside the bulb 16 is forced through the openings 33 and into the air passage 25 closing the check valve 38 in the dispensing valve 17 and opening the check valve 29 in the fitting 14 allowing pressurized air to enter the container 11. When the bulb 16 is released, the check valve 29 in the fitting 14 closes trapping air inside the container 11 and the check valve 38 in the dispensing valve 17 opens allowing air from atmosphere to enter the bulb 16 for the next compression. It has been found that a bulb having a 1.8 oz. capacity after ten compressions will deliver a satisfactory liquid flow rate of 1 oz. per second.

After the container 11 has been sufficiently pressurized the bulb is placed in the holder 52. When the user desires a drink, he or she removes the bulk 16 from the holder and places the outward end of the nozzle portion of the dispensing valve into his or her mouth and presses down on the finger pad 51 of the plunger 46. This action opens the normally sealed central passage 44 of the nozzle 43 and the air pressure inside the container 11 forces liquid into the tubing 32 inside the bottle and through the liquid passage 26 and the central passage 44 in the nozzle 43 into the mouth of the user.

While this invention has been described fully and completely with special emphasis upon a preferred embodiment, it should be understood that within the scope of the appended claims the invention may be practiced otherwise than as specifically described herein.

I claim:

1. A person-carried or vehicle-carried portable liquid dispenser comprising;

a liquid container having a filling cap for receiving liquids, a single flexible dispensing tube having two separate, longitudinally-extending, substantially parallel passages extending from end to end thereof, said tube having one end attached to and opening into said filling cap and its other end extending therefrom, a dispensing valve attached to the extended end of said dispensing tube for selectively dispensing liquid from said container, pressurizing means secured on said dispensing tube in communication with one of said longitudinal passages for creating air pressure within said container, and the other of said longitudinal passages interconnecting said dispensing valve and the interior of said container whereby operation of said dispensing valve permits flow of liquid from said container through said other longitudinal passage.

2. A dispenser according to claim 1 in which said cap includes a fitting having separate passages communicating with the interior of said container and providing means for effecting a fluid-tight connection to the respective longitudinal passages of said tube.

3. A dispenser according to claim 2 in which said fitting comprises separate tubular extensions extending outwardly and inwardly from said cap.

4. A dispenser according to claim 1 in which said pressurizing means comprises a compressible hollow bulb of resilient material sealed at each end around said dispensing tube to form an inner chamber, and said dispensing tube having an opening communicating said inner chamber with one of said longitudinal passages for forcing air into said container on compression of said bulb.

5. A dispenser according to claim 2 in which said fitting comprises a short upwardly extending air inlet tube and a short upwardly extending liquid outlet tube, said inlet tube adapted to be received within one passage of said dispensing tube and said liquid outlet tube adapted to be received within the other passage of said dispensing tube, said inlet tube having a hollow enclosed chamber depending from the underside of said filling cap and containing a ball check valve mechanism, said chamber having a small opening in the side wall thereof in communication with the interior of said container above the liquid level, said liquid outlet tube having a short hollow open portion depending from the underside of the cap, and a length of tubing secured on said hollow open portion and extending downwardly therefrom to terminate adjacent to the bottom of said container.

6. A dispenser according to claim 1 in which said dispensing valve comprises a valve housing having a fluid inlet and a fluid outlet and a valve opening therebetween, said fluid inlet being connected to the extended end of said tube to receive fluid flowing therethrough, a valve member in said housing movable into and out of closing relation to said valve opening and having a manual operator member extending outside said housing, and a spring urging said valve member toward a normally closed position.

7. A dispenser according to claim 6 in which said fluid outlet comprises a generally inverted L-shaped nozzle member having a depending leg portion secured within the interior of said housing, said nozzle member having a central bore extending through each leg portion, the bore of said depending leg being diametrically smaller than the interior of said housing to define a radial shoulder therebetween comprising said valve opening, a plunger member having a tubular shaft portion slidably received within the central bore of said depending leg portion and extending outwardly from each end thereof, said shaft portion having finger pad on the upwardly extended end comprising said manual operator and a reduced diameter portion at the depending end to receive an elastomeric seal member comprising said valve member retained thereon by a retainer member secured to said reduced diameter portion, and said spring comprising a compression spring biased between the bottom of said housing and the underside of said retainer member to urge said seal upwardly against said radial shoulder.

8. A dispenser according to claim 7 in which said dispensing valve includes a short laterally extending air inlet tube and a short laterally extending liquid outlet tube, said air inlet tube fitting in said one passage of said dispensing tube and said liquid outlet tube fitting in said other passage of said dispensing tube, said air inlet tube having an air passage extending inwardly to communicate with the lower portion of a hollow chamber extending upwardly therefrom and containing a ball check valve, said chamber enclosed at its top end by a cap member having an aperture therethrough for communication with atmosphere, said liquid outlet tube having a liquid passage extending inwardly to communicate with a hollow vertical fluid chamber comprising said housing.

9. A dispenser according to claim 1 including a thermally insulating sleeve enclosing and carrying said container, and said sleeve including fastening means releasably attaching said sleeve in a convenient operating position.

10. A dispenser according to claim 9 in which said sleeve comprises an outer layer of protective fabric, and an inner lining of thermally insulating material.

11. A dispenser according to claim 10 in which said inner lining of thermally insulating material comprises polyurethane foam material.

12. A dispenser according to claim 9 in which said fastening means comprises at least one element of a hook and loop fabric fastener affixed to the outer surface of said sleeve, the other element of said hook and loop fabric fastener being adapted to be secured at said convenient operating position.

13. A dispenser according to claim 9 in which said fastening means of said sleeve comprises at least one fastener having slots therein affixed to the outer surface of said sleeve for receiving straps.

14. A dispenser according to claim 9 in which said fastening means of said sleeve comprises at least one element of a hook and loop fabric fastener and at least one fastener having slots affixed to the outer surface of said sleeve in a circumferentially spaced apart, radially opposed relation.

15. A dispenser according to claim 9 further including a holder means for releasably holding said pressurizing means.

16. A dispenser according to claim 15 in which said holder comprises a downwardly tapered semi-cylindrical sidewall defining a concave surface greater than 180 degrees in circumferential extent, and attachment means for releasably attaching said holder at a convenient operating location.

17. A dispenser according to claim 16 in which said attachment means of said holder comprises a belt clip.

18. A dispenser according to claim 1 in which said cap includes a fitting having separate passages communicating with the interior of said container and providing means for effecting a fluid-tight connection to the respective longitudinal passages of said tube, further including a thermally insulating sleeve enclosing and carrying said container, and said sleeve including fastening means for releasably attaching said sleeve in a convenient operating position.

19. A dispenser according to claim 18 in which said sleeve comprises an outer layer of protective fabric, and an inner lining of thermally insulating material.

20. A dispenser according to claim 19 in which said inner lining of thermally insulating material comprises polyurethane foam material.

21. A dispenser according to claim 18 in which said fitting comprises separate tubular extensions extending outwardly and inwardly from said cap.

22. A dispenser according to claim 18 in which said pressurizing means comprises a compressible hollow bulb of resilient material sealed at each end around said dispensing tube to form an inner chamber, and said dispensing tube having a cylindrical external surface and an opening communicating said inner chamber with said one of said longitudinal passages for forcing air into said container on compression of said bulb.

23. A dispenser according to claim 18 in which said fitting comprises a short upwardly extending air inlet tube and a short upwardly extending liquid outlet tube, said inlet tube adapted to be received within said one passage of said dispensing tube and said liquid outlet tube adapted to be received within the other passage of said dispensing tube, said inlet tube having a hollow enclosed chamber depending from the underside of sid filling cap and containing a ball check valve mechanism, said chamber having a small opening in the side wall thereof in communication with the interior of said container above the liquid level, said liquid outlet tube having a short hollow open portion depending from the underside of the cap, and a length of tubing secured on said hollow open portion and extending downwardly therefrom to terminate adjacent to the bottom of said container.

24. A dispenser according to claim 18 in which said dispensing valve comprises a valve housing having a fluid inlet and a fluid outlet and a valve opening therebetween, said fluid inlet being connected to the extended end of said tube to receive fluid flowing therethrough, a valve member in said housing movable into and out of closing relation to said valve opening and having a manual operator member extending outside said housing, and a spring urging said valve member toward a normally closed position.

25. A dispenser according to claim 24 in which said fluid outlet comprises a generally inverted L-shaped nozzle member having a depending leg portion secured within the interior of said housing, said nozzle member having a central bore extending through each leg portion, the bore of said depending leg being diametrically smaller than the interior of said housing to define a radial shoulder therebetween comprising said valve opening, a plunger member having a tubular shaft portion slidably received within the central bore of said depending leg portion and extending outwardly from each end thereof, said shaft portion having finger pad on the upwardly extended end comprising said manual operator and a reduced diameter portion at the depending end to receive an elastomeric seal member comprising said valve member retained thereon by a retainer member secured to said reduced diameter portion, and said spring comprising a compression spring biased between the bottom of said housing and the underside of said retainer member to urge said seal upwardly against said radial shoulder.

26. A dispenser according to claim 25 in which said dispensing valve includes a short laterally extending air inlet tube and a short laterally extending liquid outlet tube, said air inlet tube fitting in said one passage of said dispensing tube and said liquid outlet tube fitting in said other passage of said dispensing tube, said air inlet tube having an air passage extending inwardly to communicate with the lower portion of a hollow chamber extending upwardly therefrom and containing a ball check valve, said chamber enclosed at its top end by a cap member having an aperture therethrough for communication with atmosphere, said liquid outlet tube having a liquid passage extending inwardly to communicate with a hollow vertical fluid chamber comprising said housing.

27. A person-carried or vehicle-carried portable liquid dispenser comprising;

a liquid container having a filling cap for receiving liquids, tube means having two separate, longitudinally-extending, passageways, extending in closely spaced parallel relation for substantially their entire length, said tube means having one end attached to and opening into said filling cap and its other end extending therefrom, a dispensing valve attached to the extended end of said tube means in communication with only one of said passageways for selectively dispensing liquid from said container, pressurizing means secured on said tube means surrounding both of said passageways but in communication with only the other one of said passageways for creating air pressure within said container, and said one passageway interconnecting said dispensing valve and the interior of said container whereby operation of said dispensing valve permits flow of liquid from said container through said one passageway and out of said valve.

* * * * *